US009073307B2

(12) United States Patent
Usuda et al.

(10) Patent No.: US 9,073,307 B2
(45) Date of Patent: Jul. 7, 2015

(54) PRINTING APPARATUS, PRINTING METHOD AND PRINTED MATTER

(71) Applicant: SEIKO EPSON CORPORATION, Tokyo (JP)

(72) Inventors: Hidenori Usuda, Matsumoto (JP); Takayoshi Kagata, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 210 days.

(21) Appl. No.: 13/756,166

(22) Filed: Jan. 31, 2013

(65) Prior Publication Data

US 2013/0201232 A1 Aug. 8, 2013

(30) Foreign Application Priority Data

Feb. 2, 2012 (JP) ..... 2012-020764

(51) Int. Cl.

*B41J 2/01* (2006.01)
*B41J 2/04* (2006.01)
*B41J 2/21* (2006.01)

(52) U.S. Cl.

CPC . *B41J 2/04* (2013.01); *B41J 2/2107* (2013.01); *B41J 2/2114* (2013.01)

(58) Field of Classification Search

CPC ..... B41J 2/01; B41J 2/211; B41J 2/1433; B41J 2/17; B41J 2/17593; B41J 2/2107; B41J 2/1755; B41J 2/2114; B41J 11/0015; B41J 2/2056; B41J 2/21; C09D 11/36; C09D 11/40; C09D 11/30; C09D 11/38; C09D 11/322; C09D 11/328; C09D 11/101; C09D 11/005; C09D 11/54; C09D 11/52; B41M 5/0011; B41M 5/0017; B41M 7/00

USPC ..... 347/100, 95, 96, 101, 88, 99, 20, 21, 9; 106/31.13, 31.6, 31.27; 523/160, 161

See application file for complete search history.

(56) References Cited

U.S. PATENT DOCUMENTS

| | | | | |
|---|---|---|---|---|
| 7,244,021 | B2 | 7/2007 | Arai | 347/102 |
| 2007/0279470 | A1 | 12/2007 | Arai | 347/102 |
| 2007/0281136 | A1* | 12/2007 | Hampden-Smith et al. | 428/195.1 |
| 2011/0032299 | A1* | 2/2011 | Mimura | 347/15 |

FOREIGN PATENT DOCUMENTS

| | | |
|---|---|---|
| JP | 08-150800 | 6/1996 |
| JP | 09-240133 | 9/1997 |
| JP | 2001-096886 | 4/2001 |
| JP | 2001-260517 | 9/2001 |
| JP | 2004-122505 | 4/2004 |
| JP | 2004/306591 | 11/2004 |

* cited by examiner

*Primary Examiner* — Manish S Shah
(74) *Attorney, Agent, or Firm* — DLA Piper LLP (US)

(57) ABSTRACT

A printing apparatus includes a first nozzle through which to discharge color ink to form a first dot, a second nozzle through which to discharge at least one of white ink, clear ink, and first glitter ink to form a second dot, a third nozzle through which to discharge second glitter ink, lower in diffuse reflection rate than the ink discharged from the second nozzle, to form a third dot, in which an image to be visually recognized from the opposite side of an image formation side via a printable medium is formed by forming a glittering base layer, resulting from the third dot, on a color image and the second dot, after forming the color image, resulting from the first dot, on the printable medium and forming the second dot on the first dot making up the color image.

8 Claims, 8 Drawing Sheets

PRINTING APPARATUS, PRINTING METHOD AND PRINTED MATTER

CROSS-REFERENCE TO RELATED APPLICATIONS

This application claims priority to Japanese Patent Application No. 2012-020764 filed on Feb. 2, 2012. The entire disclosure of Japanese Patent Application No. 2012-020764 is hereby incorporated herein by reference.

BACKGROUND

1. Technical Field

The present invention relates to a printing apparatus, a printing method and a printed matter.

2. Related Art

A copy machine performs the copying on, for example, a sheet of paper by emitting light to a manuscript, and reading the manuscript, based on the result of a sensor detecting diffuse reflection light from the manuscript. For this reason, to prevent the forgery by the copying, the method is proposed in which a part, where an amount of specular reflection is large with respect to incident light, is provided on a printed matter such as a gift certificate, a security and a certificate, and thus the copying is not appropriately performed. For example, the provision of a flattened portion, the provision of a layer of dark color system ink in a base of pearly glossy ink, and the provision of a glossy portion, resulting from a layer of metal, are known (for example, refer to JP-A-8-150800, JP-A-9-240133, and JP-A-2004-122505).

Furthermore, the method is proposed in which an image resulting from glossy ink is formed after forming a base layer on the surface of a printable medium and flattening the base layer, in order to get rid of the inconvenience that a pigment of glossy ink expressing metallic glossiness and pearly glossiness, which is buried in a concavity and convexity in the printable medium, is not able to show glossiness (for example, refer to JP-A-2001-96886 and JP-A-2001-260517).

On the other hand, there is a form of printing in which the printing is performed by superimposing a color image and a glittering base layer in order to print the color image having the glittering property (for example, the color image having the metallic glossiness). In the printed matter on which the color image and the glittering base layer are superimposed, there occurs a case where an amount of the specular reflection with respect to the incident light is increased and thus the color may not be read and the copying is not appropriately performed. There is an inconvenient case where the copying is not appropriately performed in the printed matter in which the color image and the glittering base layer are superimposed without the purpose of preventing the forgery, and thus it is preferable that the copying is made appropriately performed.

SUMMARY

An advantage of some aspects of the invention is to enable a printed matter, on which a color image and a glittering base layer are superimposed, to be appropriately read.

According to an aspect of the invention, there is provided a printing apparatus including a first nozzle through which to discharge color ink to form a first dot, a second nozzle through which to discharge at least one of white ink, clear ink, and first glitter ink to form a second dot, a third nozzle through which to discharge second glitter ink, lower in diffuse reflection rate than the ink discharged from the second nozzle, to form a third dot, and a control unit that controls discharge of the ink through the first nozzle, the second nozzle, and the third nozzle, in which the control unit performs control in such a manner that an image to be visually recognized from the opposite side of an image formation side via a printable medium is formed by forming a glittering base layer, resulting from the third dot, on a color image and the second dot using the third nozzle, after forming the color image, resulting from the first dot, on the printable medium using the first nozzle, and forming the second dot on the first dot making up the color image using the second nozzle.

Other features of the invention are made definite by descriptions of the present specification and the drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
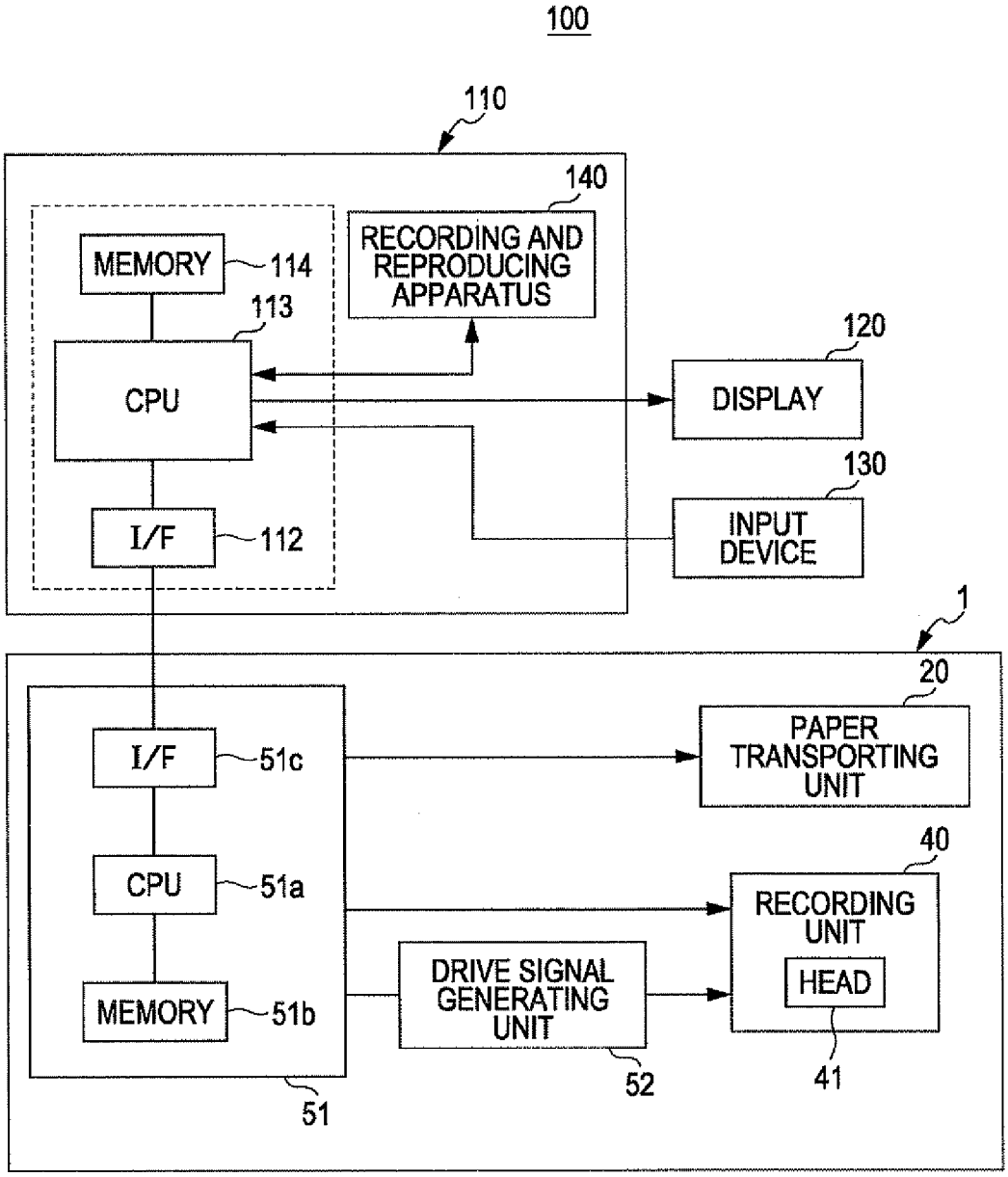
FIG. 1 is a block diagram illustrating a printing system.

The following matters are at least made definite by descriptions of the present specification and the accompanying drawings.

That is, a printing apparatus includes a first nozzle through which to discharge color ink to form a first dot, a second nozzle through which to discharge at least one of white ink, clear ink, and first glitter ink to form a second dot, a third nozzle through which to discharge second glitter ink, lower in diffuse reflection rate than the ink discharged from the second nozzle, to form a third dot, and a control unit that controls discharge of the ink through the first nozzle, the second nozzle, and the third nozzle, in which the control unit performs control in such a manner that an image to be visually recognized from the opposite side of an image formation side via a printable medium is formed by forming a glittering base layer, resulting from the third dot, on a color image and the second dot using the third nozzle, after forming the color image, resulting from the first dot, on the printable medium using the first nozzle, and forming the second dot on the first dot making up the color image using the second nozzle.

According to the printing apparatus like this, the diffuse reflection rate of a printed matter, on which the color image and the glittering base layer are superimposed, may be increased and the printed matter may be printed which is appropriately read into, for example, a copy apparatus.

In the printing apparatus, the control unit causes the second dot to be formed in a region where the first dot making up the color image is not present, in a region on the printable medium, where the glittering base layer is formed, using the second nozzle.

According to the printing apparatus like this, the printed matter may be printed in which a region on which the color image is not formed is also appropriately read.

In the printing apparatus, the control unit determines a discharge duty of the second nozzle, when forming the second dot in the region where the first dot is not present, as a discharge duty in the range from 5% to 20%.

According to the printing apparatus like this, it is possible that a diffuse reflection rate of the region on which the color image is not formed is increased.

In the printing apparatus, the second nozzle may form the second dot with multiple sizes, and the control unit causes the second dot, which has the smallest of the multiple sizes, to be formed in the region where the first dot is not present, using the second nozzle.

According to the printing apparatus like this, the printed matter may be printed in which the region on which the color image is not formed is also appropriately read.

In the printing apparatus, the control unit causes the glittering base layer resulting from the first dot and the third dot to be formed using the first nozzle and the third nozzle.

According to the printing apparatus like this, a tone of the glittering base layer may be adjusted.

In the printing apparatus like this, the first glitter ink is ink that contains aluminum pieces.

According to the printing apparatus like this, it is possible that the diffuse reflection rate of the printed matter is increased.

Furthermore, a printing method of forming an image that is visually recognized from the opposite side of an image formation side via a printable medium, includes forming a color image, resulting from forming a first dot, by discharging color ink onto the printable medium, forming a second dot by discharging at least one of white ink, clear ink and first glitter ink onto the first dot making up the color image, and forming a glittering base layer, resulting from forming a third dot, by discharging a second glitter ink, lower in diffuse reflection rate than the ink resulting in the second dot, onto the color image and the second dot.

According to the printing method like this, the diffuse reflection rate of the printed matter, on which the color image and the glittering base layer are superimposed, may be increased and a printed matter may be printed which is appropriately read into, for example, a copy apparatus.

Furthermore, in a printed matter that is visually recognized from the opposite side of an image formation side via a printable medium, a color image resulting from a first dot, which is a dot of color ink, is formed on the printable medium, a second dot resulting from discharging at least one of white ink, clear ink, and first glitter ink is formed onto the first dot making up the color image, and a glittering base layer resulting from a third dot, which is a dot of second glitter ink, lower in diffuse reflection rate than the ink resulting in the second dot, is formed on the color image and the second dot.

According to the printed matter, the diffuse reflection rate is increased and is appropriately read into, for example, the copy apparatus.

On Printing System

An embodiment is described with a "pringing apparatus" defined as an ink jet printer (hereinafter referred to as a printer).

Figure 2:
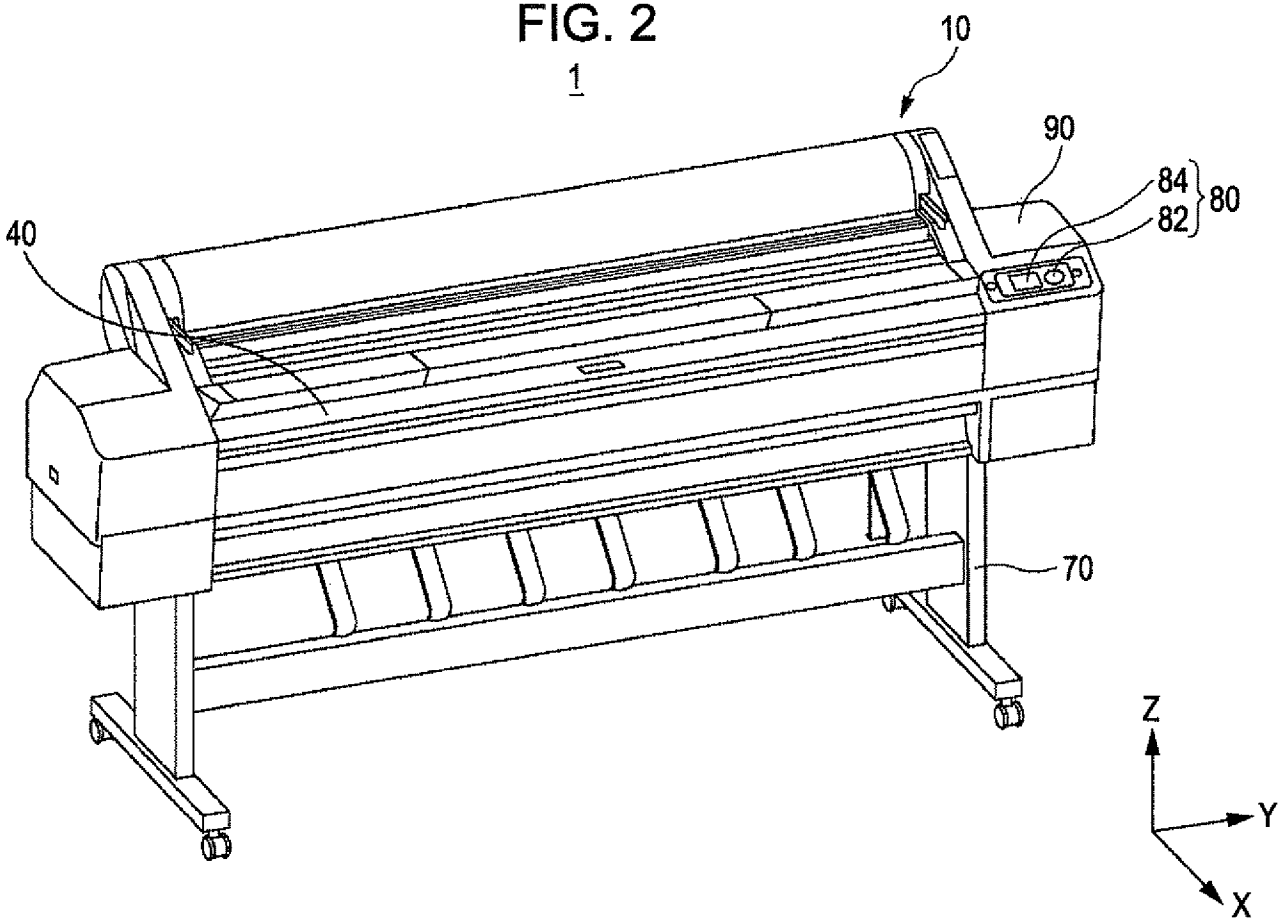
FIG. 2 is a perspective view illustrating a printer.
Figure 3:
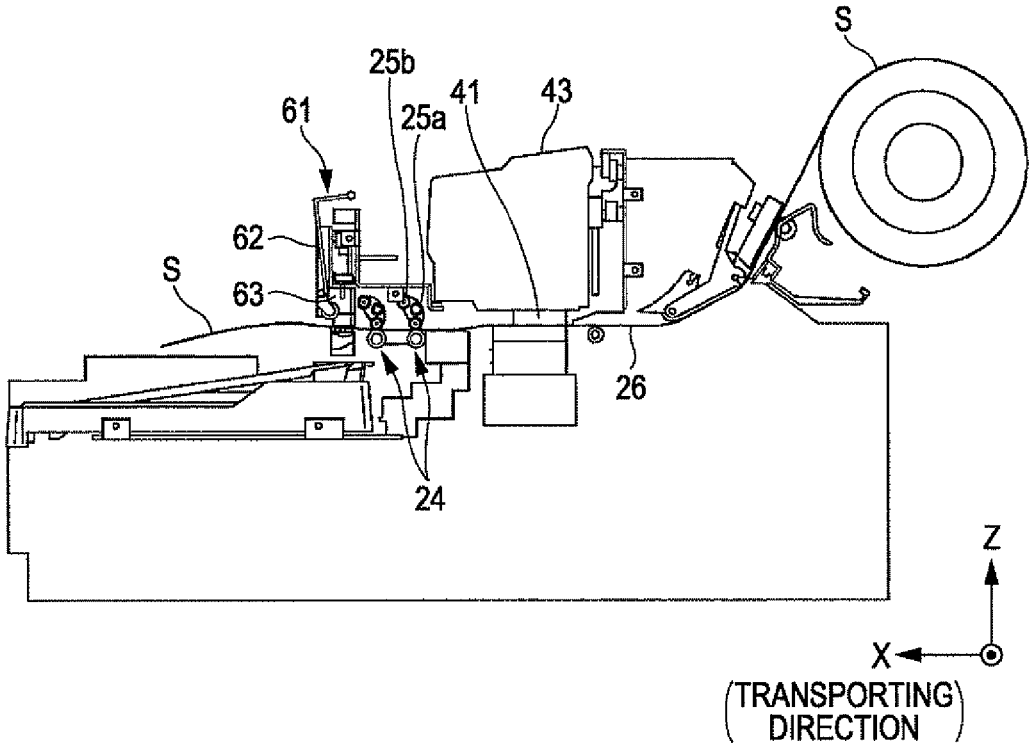
FIG. 3 is a side view illustrating the inside of the printer.

FIG. 1 is a block diagram illustrating a printing system 100. FIG. 2 is a perspective view illustrating a printer 1. FIG. 3 is a side view illustrating the inside of the printer 1. The printing system 100 has the printer 1, a computer 110, a display 120, and an input device 130. The printer 1 prints an image on a printable medium S such as a sheet of paper, a piece of cloth, and a film. Furthermore, in the following description, the transporting direction (the discharging direction) of the printable medium S is referred to as the X-axis direction, the width direction (the direction perpendicular to the paper in FIG. 3) of a transportation path 26 intersecting the X axis direction as the Y axis direction and the vertical direction intersecting the X axis direction and the Y axis direction as the Z axis direction.

The computer 110 is connected to the printer 1 via an interface 112 in a communication-enabled manner. And in order to cause the printer 1 to print the image, the computer 110 outputs print data, which corresponds to the image, to the printer 1. The computer 110 includes the interface 112, a CPU (a Central Processing Unit) 113, a memory 114, and a recording and reproducing device 140. Furthermore, a computer program, such as a printer driver, which creates print data and outputs the created print data, is installed in the computer 110. The computer program may be stored on a recordable media, such as CD-ROM (Compact Disk Read Only Memory) or be downloaded over the Internet. The recording and reproducing device 140, for example, is the CD-ROM drive. Furthermore, the display 120, for example, is a liquid crystal monitor. The display 120, for example, is one for displaying a user interface of the computer program. The input devices 130, for example, is a keyboard or a mouse.

The printer 1 includes a paper transporting unit 20, a recording unit 40, a control unit 51, and a drive signal generating unit 52. Furthermore, as illustrated in FIG. 2, the printer 1 includes the recording unit 40 that is arranged in such a manner that the longitudinal direction is the horizontal direction, a housing 90 that is mounted on an end portion of the recording unit 40, a load portion 10 mounted above the recording unit 40, and a leg portion 70 supporting the recording unit 40 and the housing 90 from below. Furthermore, as illustrated in FIG. 2, an operating panel 80 is arranged on the upper surface of the housing 90. The operating panel 80 includes multiple switches 82 that the user operates and additionally a displaying unit 84 displaying the operation status of the printer 1. Accordingly, when the side to which the operating panel 80 is arranged is defined as the front side, the user operates the printer 1 from this front side.

The paper transporting unit 20, as illustrated in FIG. 3, supplies the printable medium S, which is wound in the shape of a roller, to the recording unit 40, and transports the printable medium S in the X axis direction. The recording unit 40 performs the image formation on the print media S. The control unit 51 includes a CPU 51*a* that performs, for example, a calculation, a memory 51*b* that stores, for example, a program and a calculation result, and an interface 51*c* that performs a communication with an external apparatus, and controls the operation of each of the constituent devices described above in an integrating manner. For example, the control unit 51 controls the discharge of the ink through the nozzle provided in the head 41. The drive signal generating unit 52 generates a drive signal COM and supplies the drive signal COM to each piezoelectric element PZT (to be described below) that the head 41 has. For this operation, digital data, which specifies the shape of the drive signal COM, is sent from the control unit 51 to the drive signal generating unit 52, and the drive signal generating unit 52 generates the drive signal COM that is a voltage waveform, based on the digital data.

The recording unit 40, as illustrated in FIG. 3, includes the head 41 that discharges the ink with respect to the printable medium S that arrives by transportation along the transportation path 26. The head 41 is mounted on the carriage 43 that is freely movable in the width direction (the Y axis direction) of the transportation path 26. Furthermore, an ink cartridge, not illustrated, which stores the ink, is mounted in the printer 1 and the ink of each color is supplied from the ink cartridge to the head 41. While being moved by the carriage 43 in the Y axis direction, the head 41 discharges the ink of each color with respect to the recordable surface of the printable medium S. For example, predetermined image information and predetermined letter information are formed on the printable medium S by repeating this discharging operation and the operation of the transportation of the printable medium S by the paper transporting unit 20 in the X axis direction.

The printable medium S, on which the image formation is performed with the recording unit 40, is discharged from a discharge roller 24. The discharge roller 24 includes a mechanism that changes a roller which performs the nipping according to the kind of paper, to an incision roller 25*a* or a rolling roller 25*b*. A cutting device 61, which cuts the discharged printable medium S to the predetermined size, is provided in the downstream side of the discharge roller 24. The cutting device 61 has a regulating member 62 that regulates a height position of the discharged printable medium S, and a cutting unit 63 that cuts the printable medium S by moving the printable medium S in the width direction (the Y axis direction) intersecting the discharging direction (the X axis direction) of the printable medium S.

Figure 4:
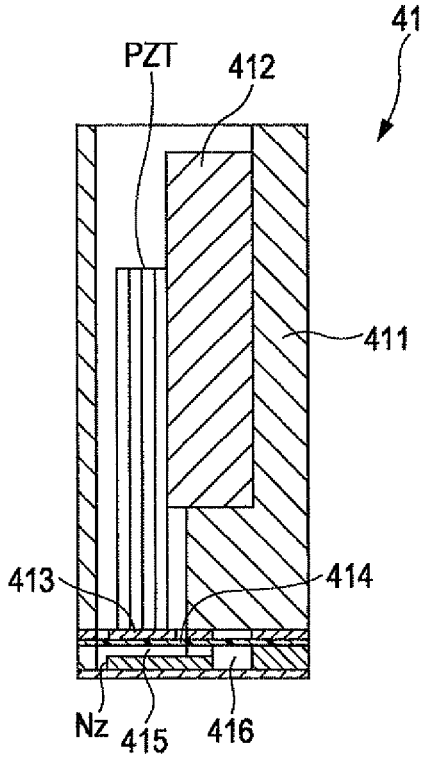
FIG. 4 is a cross-sectional view illustrating the construction of a head.

FIG. 4 is a cross-sectional view illustrating the construction of the head 41. A flow channel 416 is formed in the head 41 and the ink is supplied through the flow channel 416. An adhesion substrate 412 is fixed to a case 411 of the head 41. The adhesion substrate 412 is in the rectangular-shaped plate, and additionally the piezoelectric element PZT adheres to one surface of the adhesion substrate 412. An island portion 413 is connected to the tip of the piezoelectric element PZT, and an elastic region resulting from an elastic film 414 is formed in the vicinity of the island portion 413.

The piezoelectric element PZT is transformed by applying a potential difference between the opposing electrodes. In this example, the piezoelectric element PZT expands and contracts in the longitudinal direction. An amount of expansion and contraction is determined according to the potential of the piezoelectric element PZT. And when the piezoelectric element PZT expands and contracts, the island portion 413 is pushed to the side of a pressure chamber 415 and is pulled in the opposite direction. At this time, since the elastic film 414 in the vicinity of the island portion is transformed, the ink may be efficiently ejected through the nozzle Nz that communicates with the pressure chamber 415.

Furthermore, the nozzles Nz are enabled to form the dots with the multiple sizes. By applying a drive pulse according to a size of the dot that has to be formed, among multiple drive pulses (not illustrated) that the drive signal COM has, to the piezoelectric element PZT, an amount of the ink according to the corresponding size of the dot may be discharged through the nozzles Nz.

Figure 5:
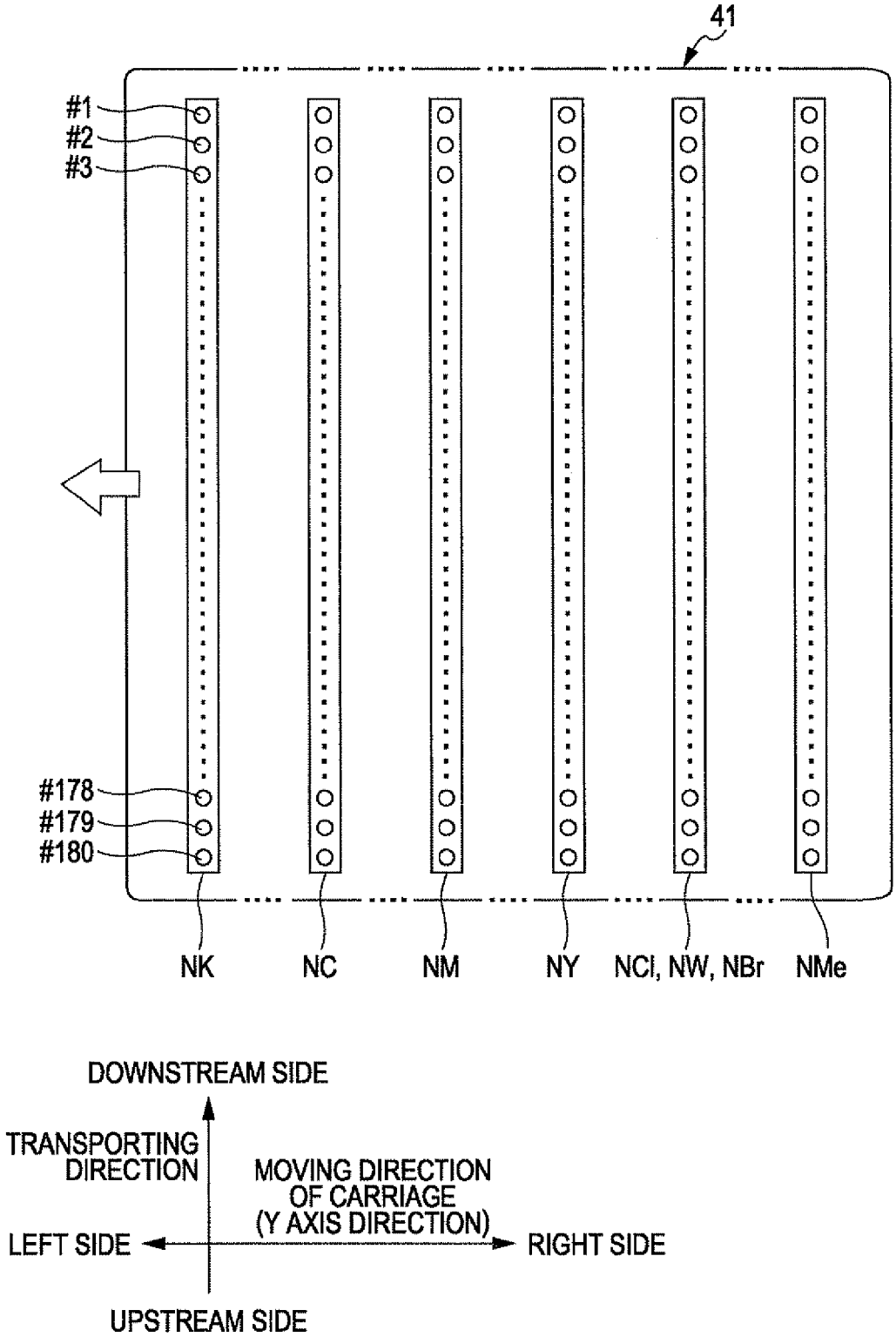
FIG. 5 is a view illustrating the arrangement of nozzles formed in the lower surface of the head.

FIG. 5 is a view illustrating the arrangement of the nozzles Nz formed in the lower surface of the head 41. In addition, FIG. 5 is a view illustrating the virtual arrangement of the nozzles Nz when viewed from the upper surface of the head 41. A row NK of black ink nozzles through which to discharge black ink K, a row NC of cyan ink nozzles through which to discharge cyan ink C, a row NM of magenta ink nozzles through which to discharge magenta ink M, a row NY of yellow ink nozzles through which to discharge yellow ink Y, a row NC1 of clear ink nozzles through which to discharge clear ink C1, and a row NMe of metallic ink nozzles through which to discharge metallic ink Me are formed in the lower surface of the head 41. In each row of nozzles, multiple nozzles No. 1 to No. 180 are arranged at predetermined intervals in a line in the transporting direction.

In addition, according to the present embodiment, the clear ink C1 is defined as colorless transparent ink that does not contain color material, but is not limited to this kind of ink, and for example, may be ink (translucent ink) that has a little color material but has transparency.

On Copy Apparatus

Figure 6:
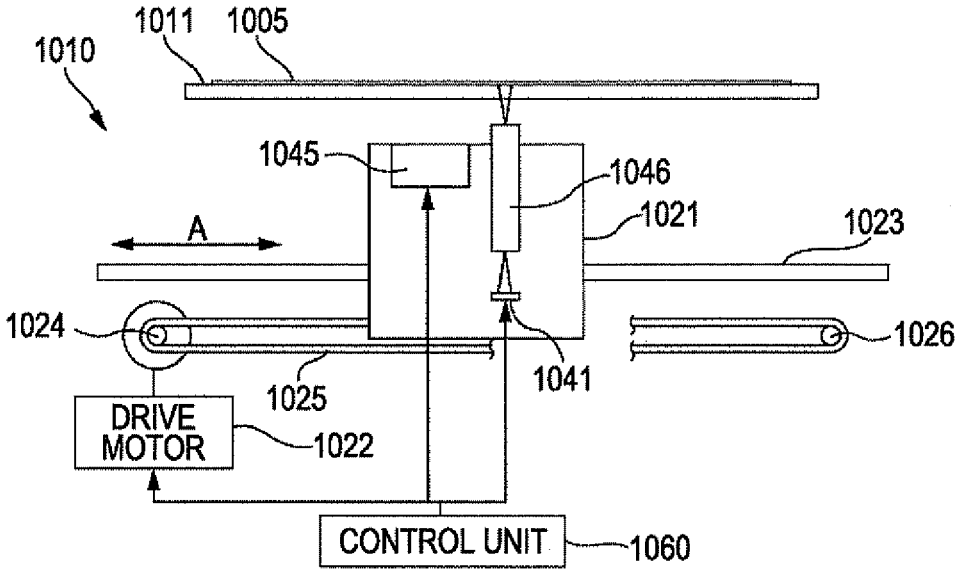
FIG. 6 is a view illustrating a reading mechanism in a copy apparatus.

FIG. 6 is a view illustrating a reading mechanism 1010 in the copy apparatus. The reading mechanism 1010 includes a carriage 1021 and a carriage moving mechanism below a manuscript supporter 1011. While maintaining a distance between the carriage 1021 and the manuscript supporter 1011 as a predetermined distance, the carriage moving mechanism moves the carriage 1021 along a guide 1023 extending in the A direction indicated by the arrow in the drawing. The carriage moving mechanism has a drive motor 1022, a guide 1023, a shaft 1024, a belt 1025, and a pulley 1026. The drive motor 1022, which drives in response to a drive signal from a control unit 1060, rotates the shaft 1024, and the rotation of the belt 1025, which is placed on the shaft 1024 and the pulley 1026, moves the carriage 1021, connected to the belt 1025, in the A direction.

An exposure lamp 1045 (a light source), which emits light to a manuscript 1005 via the manuscript supporter 1011, a lens 1046, on which the light, diffuse-reflected by the manuscript 1005, is incident, and an image sensor 1041, which receives the diffuse reflection light importing into the carriage 1021 via the lens 1046, are provided in the carriage 1021.

The image sensor 1041 is configured to include a linear CCD sensor in which photoelectric transducers, such as photo diodes, which convert an optical signal to an electrical signal, are arranged in a low. Data on the image, read by the image sensor 1041 is output to the control unit 1060. The copy apparatus performs the copying on, for example, the sheet of paper, based on the diffuse reflection light data input to the control unit 1060.

Figure 7:
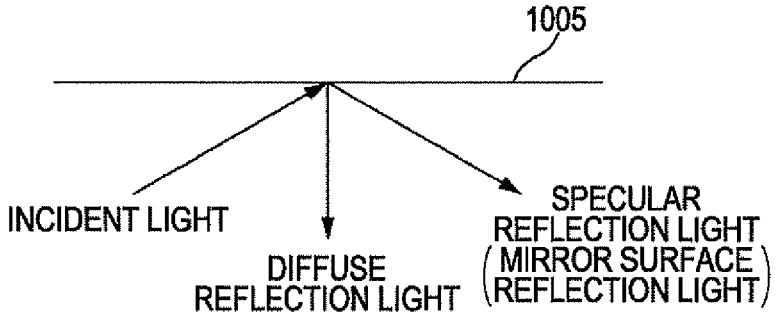
FIG. 7 is a view illustrating specular reflection light (mirror surface reflection light) and diffuse reflection light.

FIG. 7 is a view illustrating the specular reflection light (the mirror surface reflection light) and the diffuse reflection light. The light from the exposure lamp 1045, which is incident on the manuscript 1005, is reflected as the specular reflection light in which the reflection angle is equal to the incidence angle, and as the diffuse reflection light that is reflected at angles other than the incidence angle. In the reading mechanism 1010 of the copy apparatus, light is caused to be incident on the manuscript 1005 by the exposure lamp 1045 and then the light, diffuse-reflected at the manuscript 1005, is caused to be read by the image sensor 1041. Because of this, when a rate of the diffuse reflection light to the reflection light is appropriate, the color of the manuscript 1005 is correctly read and the copying is appropriately performed. On the other hand, when the rate of the specular reflection light to the reflection light is increased and an amount of the diffuse reflection light is insufficient, the color of the manuscript 1005 is not accurately read and thus the copying is not appropriately performed. Specifically, a region where the amount of the diffuse reflection light is small is copied in black.

On Back Printing Print

In the following description, black ink K, cyan ink C, magenta ink M, and yellow ink Y are collectively referred to as "color ink Co." The printer 1 according to the present embodiment performs the printing by superimposing a "color image" that is printed by appropriately discharging color ink Co (=KCMY) and a "metallic ink layer (equivalent to the glittering base layer Me)" that is printed by discharging metallic ink Me. In this manner, the color image that has metallic glossiness may be printed by printing the color image with the metal layer in the background.

Furthermore, the printer 1 according to the present embodiment, in a case where the printing is performed with the color image and the metallic being superimposed, a so-called "back printing print" is performed in which the color image is printed on the printable medium S earlier than the metal layer and the metal layer is superimposed on the color image. In the back printing print, the printable medium S having transparency is used because the image is printed which is visually recognized via the printable medium S from the opposite side of an image formation side (a print surface side).

In addition, the metallic ink Me (equivalent to the second glitter ink) is ink that gives metallic glossiness to the image, is comparatively high in the specular reflection rate, and is low in the diffuse reflection rate. For example, the ink that contains a metallic pigment such as fine silver particles (20 nm particles) and an organic solvent is numerated as the metallic ink Me, but the metallic ink Me is not limited to this kind of ink. Furthermore, the metallic ink is included in the glitter ink. The "glittering property" refers to a surface characteristic that specularly reflects light (mirror surface reflection), and the "glittering base layer" means a base that has the surface characteristic that specularly reflects light. The ink that results in the glittering base layer is not limited to the metallic ink Me described above, and may be whatever ink has glittering property, and for example, may be ink that gives glossiness, such as pearly glossiness.

Furthermore, in the present specification, the nozzle that belongs to the rows NK, NC, NM, and NY of nozzles through which to discharge the color ink Co is equivalent to the first nozzle, the nozzle that belongs to the row NMe of nozzles through which to discharge the metallic ink Me is equivalent to the third nozzle.

Problem with Printed Matter in which Color Image and Metal Layer are Superimposed As described above, in the copy apparatus (in FIG. 6), the manuscript 1005 is read and the copying is performed by the exposure lamp 1045 emitting light to the manuscript 1005 and the image sensor 1041 receiving the diffuse reflection light (in FIG. 7) from the manuscript 1005. Because of this, when the rate of the specular reflection light to the reflection light from the manuscript 1005 is high and an amount of the diffuse reflection light is small, the copy apparatus may not accurately read the color of the manuscript 1005 and also the copying may not be appropriately performed.

When light is emitted to the printed matter on which the color image and the metal layer (the glittering base layer) are superimposed, one part of the light penetrates the dot of the color ink Co making up the color image and a large amount of that light is specularly reflected in the metal layer. That is, the printed matter in which the color image and the metal layer are superimposed is high in the specular reflection rate and is low in the diffuse reflection rate. Because of this, even though the printed matter in which the color image and the metal layer are superimposed is copied, the light that is incident on the printed matter is specularly reflected, and an amount of the light that the image sensor 1041 receives is decreased. Consequently, the copy apparatus may not read an accurate color of the printed matter and thus the copying may not be appropriately performed. Furthermore, in addition to the copy apparatus, for the reason described above, for example, even a scanner may not appropriately read the printed matter in which the color image and the metal layer are superimposed.

Therefore, an advantage of some aspects of the present embodiment is to provide the printed matter that is appropriately read by the copy apparatus and the scanner, even though the printed matter is the printed matter in which the color image and the metal layer (the glittering base layer) are superimposed.

First Embodiment

Figure 8A:
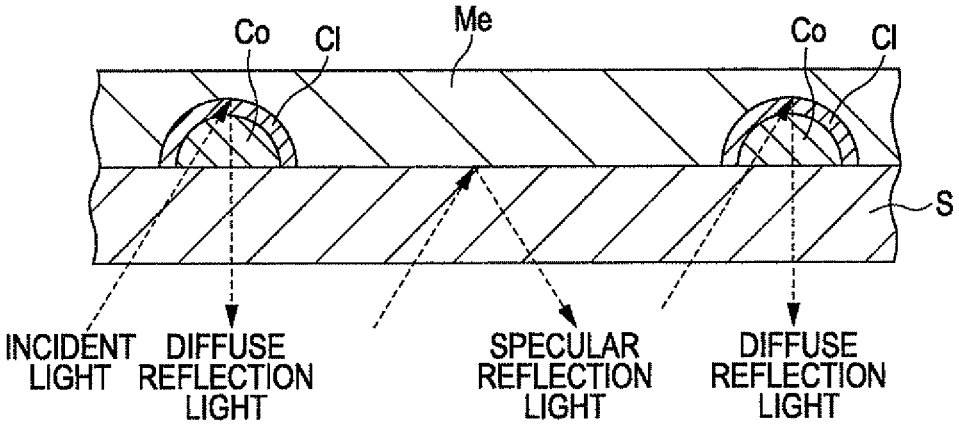
FIG. 8A is a view illustrating the forming of a dot according to a first embodiment.

FIG. 8A is a view illustrating the forming of a dot (a printed matter) according to a first embodiment. According to the first embodiment, the control unit 51 inside the printer 1 first causes the color image resulting from the color dot Co (equivalent to the first dot) to be formed, using the rows (NK, NC, NM, and NY) of nozzles through which to discharge the color ink Co with respect to the printable medium having the transparency. In addition, the color dot Co is a dot that is created by forming individually or in a multiple-superimposing manner a dot resulting from the black ink K, a dot resulting from the cyan ink C, a dot resulting from the magenta ink M, and a dot resulting from the yellow ink Y.

Next, the control unit 51 causes the clear dot C1, (equivalent to a second dot) resulting from the clear ink, to be formed on the color dot making up the color image in a superimposed manner, using the row NC1 of clear ink nozzles. In addition, when a unit region which is virtually defined on the printable medium S and in which one dot is formed is determined as a pixel, the color dot Co and the clear dot C1 are formed in the same pixel.

Lastly, the control unit 51 causes the metal layer Me (equivalent to the glittering base layer), resulting from the dot of the metallic ink Me (equivalent to the third dot), to be formed in a superimposed manner on the color image and the clear dot C1, using the row NMe of metallic ink nozzles. In addition, the metal layer Me may be the same in size as the printable medium S, may be smaller in size than the printable medium S, and may be the same in size as the color image.

The clear ink C1 is ink with a high diffuse reflection rate. Because of this, when the copy apparatus emits light to the printed matter in order to read the printed matter illustrated in FIG. 8A, the light that penetrates the color dot Co is diffused in the clear dot C1. Because of this, the rate of the diffuse reflection light from the printed matter is increased and an amount of the light that the image sensor 1041 receives may be increased. Accordingly, for example, the copy apparatus may accurately (clearly) read the color of the printed matter and also the copying of the printed matter may be appropriately performed. To sum up, the printer 1 according to the present embodiment may increase the diffuse reflection rate of the printed matter in which the color image and the glittering base layer are superimposed and may print the printed matter that is caused to be appropriately read into, for example, the copy apparatus. In addition, all of the clear dots C1 may be formed on the color dot Co, but this is not a limitation, and the clear dot C1 may be formed only on one part of the color dot Co. Also in this case, the copy apparatus may appropriately read the printed matter, compared to the case where no clear dot C1 is formed.

Furthermore, in the head 41 illustrated in FIG. 5, the rows (NK, NC, NM, and NY) of nozzles through which to discharge the color ink Co, the row NC1 of clear ink nozzles through which to discharge the clear ink C1 and the row NMe of metallic ink nozzles through which to discharge the metallic ink Me are sequentially arranged. Because of this, by discharging the ink from the head 41 while moving the head 41 from the left side of the direction of moving the carriage to the right side thereof, the dot may be formed in a superimposed manner in the sequence illustrated in FIG. 8A, that is, in the following sequence: the color dot Co, the clear dot C1, the metallic dot Me.

Furthermore, the invention is not limited to forming all of the color dot Co, the clear dot C1 and the metallic dot Me in the superimposing manner by an one-time operation (a path) in which the head 41 discharges the ink while moving in the direction of moving the carriage. For example, the printing may be performed, by setting an amount of distance that the printable medium S is transported one time, to one third or less of the length of the row of nozzles, using one third of the number of nozzles on the upstream side of the direction of transporting the rows NK, NC, NM and NY of nozzles through which to discharge the color ink Co, using one third of the number of nozzles in the center of the direction of transporting the row NC1 of clear ink nozzles, or using one third of the number of nozzles on the downstream side of the direction of transporting the row NMe of metallic ink nozzles. Also in this case, the dot may be formed in the sequence shown in FIG. 8A. Also in this case, because each dot may be formed on the different paths, oozing and color mixture may be prevented.

Furthermore, for example, the clear dot C1 may be formed on the color dot Co, while reversely transporting the printable medium S to the upstream side of the transporting direction after forming the color image, and then transporting the printable medium S to the downstream side of the transporting direction. And again, the metal layer Me is formed after reversely transporting the printable medium S to the upstream side of the transporting direction. Also in this case, the dots may be formed in a superimposed manner in the sequence illustrated in FIG. 8A. Furthermore, all of the nozzles belonging to the row of nozzles may be used.

Figure 8B:
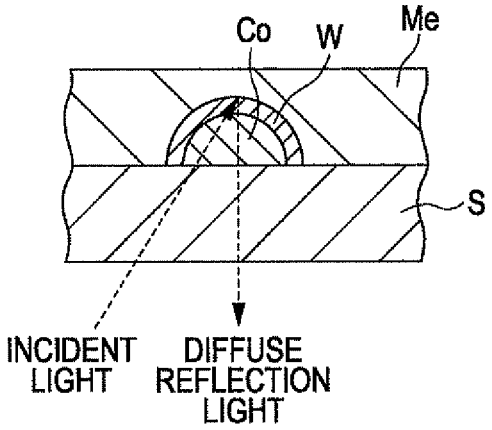
FIGS. 8B and 8C are views illustrating the forming of the dot in modification examples of FIG. 8A, respectively.
Figure 8C:
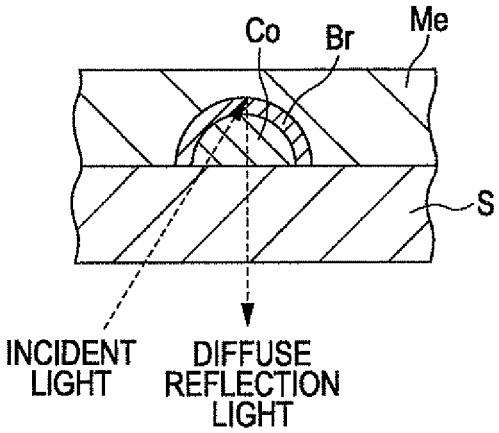

FIGS. 8B and 8C are views illustrating the forming of the dots (the printed matter) in the modification examples of FIG. 8A. Instead of the clear dot C1 being formed on the color dot Co making up the color image, the dot resulting from other ink with the high diffuse reflection rate may be formed.

For example, as illustrated in FIG. 8B, the white dot W resulting from the white ink with the high level of brightness may be formed on the color dot Co. Also in this case, because the light that penetrates the color dot Co is diffuse-reflected on the white dot W, the rate of the diffuse reflection light is increased and an amount of the light that the image sensor receives is increased. Because of this, for example, the copy apparatus may accurately read the color of the printed matter and also the copying of the printed matter may be appropriately performed. In addition, the dot that is formed on the color dot Co is not limited to the dot resulting only from the white ink W, and the dot that is a result of adjusting the tone of the white by mixing other color ink Co with the white ink W may be formed on the color dot Co.

Furthermore, as illustrated in FIG. 8C, a dot Br resulting from the glitter ink (equivalent to the first glitter ink), higher in the diffuse reflection rate than the metallic ink Me (equivalent to the second glitter ink) making up the metal layer, may be formed on the color dot Co. Also in this case, because the light that penetrates the color dot Co is diffuse-reflected in the dot Br of the glitter ink with the high diffuse reflection rate, the rate of the diffuse reflection light is increased and an amount of the light that the image sensor receives is increased. Because of this, for example, the copy apparatus may accurately read the color of the printed matter and also the copying of the printed matter may be appropriately performed.

At this point, the ink that contains aluminum pieces, each with four sides, 1 μm in side length and 20 nm in thickness, as a metallic pigment, is numerated as one example of the glitter ink Br with the high diffuse reflection rate. The flatness is difficult to form, because the size of an aluminum piece is very large, compared to a silver particle (a 20 nm particle) contained in the metallic ink Me forming the metal layer Me. Because of this, the light incident on the printed matter is caused to produce irregular reflection and thus the diffuse reflection rate of the printed matter may be increased.

In addition, the clear ink C1, the white ink W and the glitter ink Br with the high diffuse reflection rate may be formed on the color dot Co in multiple combinations. Furthermore, in a case where the printed matter illustrated in FIGS. 8B and 8C is printed, the row NW of nozzles through which to discharge the white ink W and the row NBr of nozzles through which to discharge the glitter ink Br with the high diffuse reflection rate are provided in the head 41 illustrated in FIG. 5, instead of the row NC1 through which to discharge the clear ink C1. In the present specification, the nozzles that belong to the rows NC1, NW and NBr of nozzles are equivalent to the second nozzle.

Second Embodiment

Figure 9A:
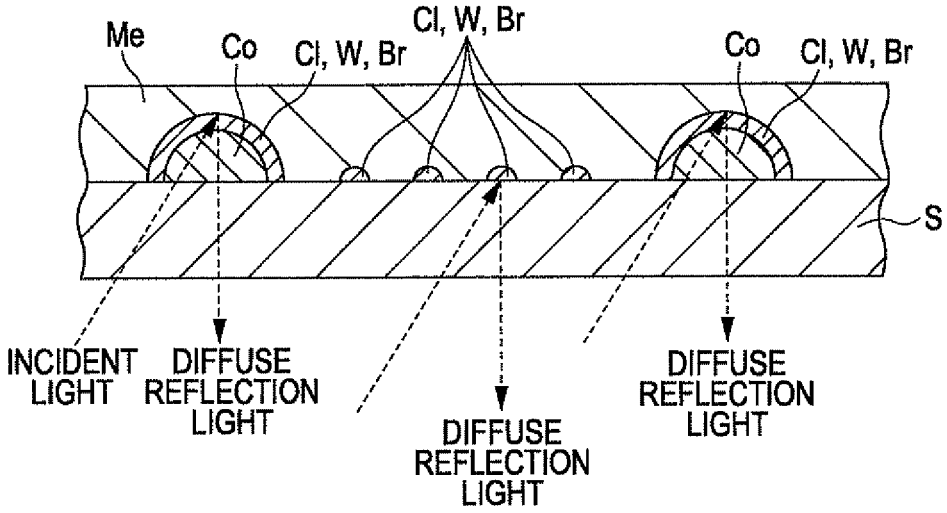
FIG. 9A is a view illustrating the forming of the dot according to a second embodiment.

FIG. 9A is a view illustrating the forming of a dot (a printed matter) according to a second embodiment. As illustrated above, a rate of diffuse reflection is increased by, for example, a clear dot C1 that is formed on a color dot Co. Because of this, when a rate of a region in which a color image is formed is high in a printable medium S, a copy apparatus, for example, may appropriately read a printed matter because the rate of the diffuse reflection is increased. On the other hand, when the rate of the region where the color image is formed is low in the printable medium S, the copy apparatus, for example, may have difficulty reading the region in which especially the color image is not formed, because an area in which diffuse reflection light is created is small.

Accordingly, according to the second embodiment, a control unit 51 causes the clear dot C1 (or a white dot W, or a dot Br resulting from glitter ink with a high diffuse reflection rate) to be formed on the color dot Co as in the first embodiment described above, and additionally causes the clear ink C1 to be formed in a sub region where the color dot Co making up the color image is not present, in a region that is on the printable medium and in which a metal layer is formed, using a row NC1 of clear ink nozzles.

By doing this, the rate of the diffuse reflection light to the whole printed matter is increased and thus an amount of light that an image sensor receives may be increased because incident light is diffuse-reflected by the clear dot C1 even though there is the region in which the color image is not formed. Because of this, for example, the copy apparatus may accurately (clearly) read the color of the printed matter and also the copying of the printed matter may be appropriately performed. To sum up, the printer 1 according to the present embodiment may print the printed matter in which also the region where the color image is not formed is appropriately read. Furthermore, an effect on the metal layer may be decreased and metal glossiness may be maintained by determining the ink to be discharged onto the region where the color image is not formed, as the clear ink C1.

Figure 9B:
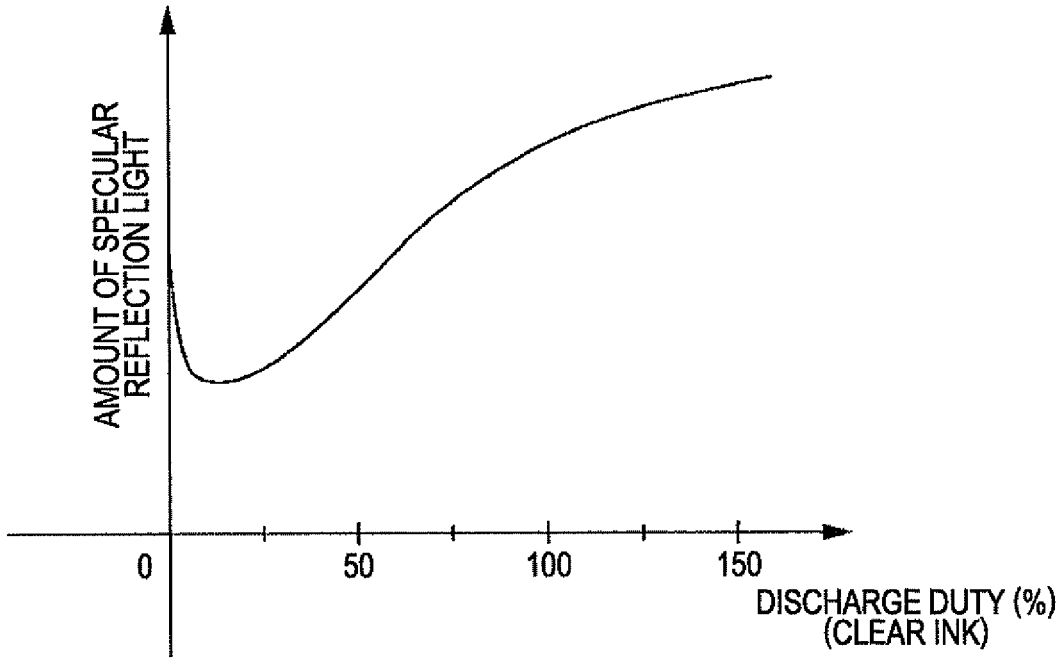
FIG. 9B is a graph showing an amount of the specular reflection light with respect to a discharge duty of clear ink, respectively.

FIG. 9B is a graph showing an amount of specular reflection light with respect to a discharge duty of the clear ink C1. A horizontal axis shows the discharge duty (%) of the clear ink C1, and a vertical axis shows the amount of the specular reflection light. The discharge duty is a rate of an area covered by the ink to a unit area of a printable media S. For example, when the dot is formed by the discharge duty of 50%, 50% of the unit area of the printable media S are covered by the clear ink C1. In other words, the dot of the clear ink C1 is formed on half of a pixel making up the unit area. According to the graph in FIG. 9B, when the discharge duty of the clear ink C1 is in the range of 5% to 20%, the amount of the specular reflection light is minimized and at this time the rate of the diffuse reflection light is increased.

Accordingly the control unit 51 performs control in such a manner that the discharge duty of the clear ink C1, when the clear dot C1 is formed in the region where the color dot Co is not present (that is, in the region where the color image is not formed), is in the range from 5% to 20%. By doing this, an optimal amount of the clear ink C1 may be discharged to increase the diffuse reflection rate of the region in which the color image is not formed and thus the diffuse reflection rate of the region, in which the color image is not formed, may be increased.

Furthermore, the control unit 51 performs the control in such a manner that the size of the dot that is to be formed in the region in which the color dot Co is not present, is the smallest of the sizes of the dots that may be formed using the row NC1 of clear ink nozzles. For example, in a case where there are three kinds of dots (a large-sized dot, a middle-sized dot, and a small-sized dot) that the clear dot C1 may form, the small-sized dot of the clear dot C1 is formed in the region where the color dot Co is not present. The forming of the small-sized dots in a great quantity may increase the diffuse reflection light in more parts rather than the forming of the large-sized dots in a small quantity. Because of this, for example, the copy apparatus may read the whole printed material more accurately. To sum up, the printer 1 according to the present embodiment may print the printed matter in which also the region where the color image is not formed is read more appropriately.

In addition, the dot to be formed in the region where the color dot Co is not present is not limited to the clear dot C1, and may be the dot W resulting from the white ink and may be the dot Br resulting from the glitter ink with the high diffuse reflection rate. Furthermore, the dot to be formed in the region where the color dot Co is not present may be made different from the dot to be formed on the color dot Co.

Third Embodiment

Figure 10:
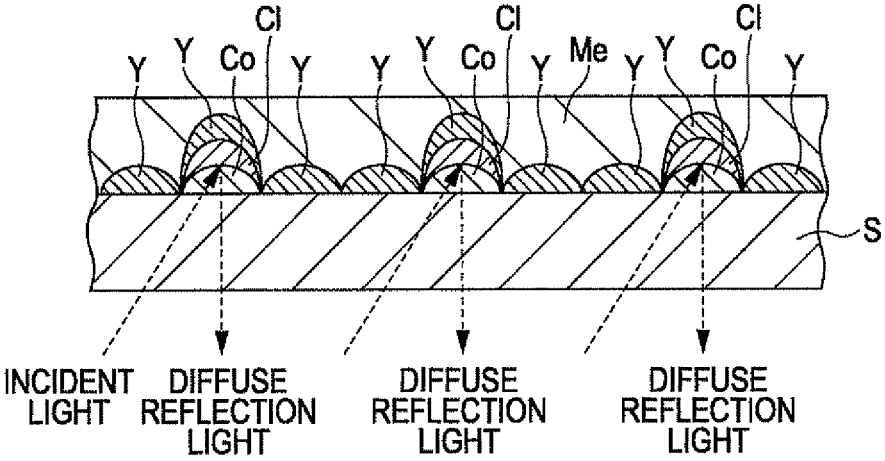
FIG. 10 is a view illustrating the forming of the dot according to a third embodiment.

FIG. 10A is a view illustrating the forming of a dot (a printed matter) according to a third embodiment. According to the third embodiment, a control unit 51 performs control in such a manner that a metal layer resulting from a dot of certain specific color ink Co (equivalent to a first dot) and a dot of metallic ink Me (equivalent to a third dot) is formed using a row (NK, NC, NM, and NY) of nozzles through which to discharge color ink Co and a row NM of metallic ink nozzles. By doing this, a tone of the metal layer Me may be adjusted according to the intended purpose of a user. For example, in FIG. 10, the metal layer Me takes on a strong yellow tone because the metal layer Me resulting from the metallic ink Me and yellow ink Y is formed. However, the ink resulting in the metal layer Me is not limited to the yellow ink Y, and may be ink of other colors (MCK), and may be color ink Co of multiple colors. Furthermore, in the metal layer Me, the ink is thickly discharged without intervals and a so-called solid coat printing is performed, but a layer of the yellow ink Y may be thicker than the metal layer Me. By doing this, the metal glossiness of the metal layer Me may be maintained.

To form a printed matter illustrated in FIG. 10, the printer 1 forms the metal layer Me resulting from the yellow ink Y and the metallic ink Me, on a color image and a clear dot C1 in a superimposing manner, after forming the color image on a printable medium S, and forming the clear dot C1 on the color dot Co making up the color image. Since the light that penetrates the color dot Co is diffuse-reflected in the clear dot C1 even when for example, a copy apparatus reads the printed matter like this, a rate of diffuse reflection light may be increased and an amount of the light that an image sensor receives may be increased. Because of this, for example, the copy apparatus may accurately read the color of the printed matter and also the copying of the printed matter may be appropriately performed.

In addition, in FIG. 10, the clear dot C1 is formed only on the color dot Co making up the color image, but the invention is not limited to this configuration, the clear dot C1 may be formed also on a region where the color image is not present as in the second embodiment. In addition, the dot to be formed on the color dot Co and in a region where the color dot Co is not present is not limited to the clear dot C1, and may be a dot W resulting from white ink and may be a dot Br resulting from glitter ink with a high diffuse reflection rate.

Other Embodiments

The embodiments described above are for the purpose of an easy understanding of the invention, and are not interpreted to limit the invention. The invention may be modified and improved without deviating from the gist thereof, and it goes without saying that the invention includes the equivalents thereof.

According to the embodiments described above, the printer 1 as a printing apparatus is described, but the invention is not limited to the printing apparatus and may be embodied as a liquid discharging apparatus that discharges fluids other than the ink (liquid, a liquid-state material in which particles of a functional material are distributed, and a fluid-state material like a gel). For example, the same technologies as the embodiments described above may be applied to various apparatuses to which the ink jet technology is applied, such as a color filter manufacturing apparatus, a dyeing apparatus, a micro processing apparatus, a semiconductor manufacturing apparatus, a surface treatment apparatus, a three-dimensional molding machine, a gas vaporization apparatus, an organic EL manufacturing apparatus (especially a high polymer EL manufacturing device), a display manufacturing apparatus, a film forming apparatus, a DNA chip manufacturing apparatus. Furthermore, methods and manufacturing methods in use with these apparatuses are also in the range of the applications of the same technologies as the embodiments described above.

According to the embodiments described above, the ink is ejected through the use of a piezoelectric element. However, the method of ejecting liquid is not limited to this configuration. For example, other methods may be employed, such as a method in which a bubble is generated within the nozzle by heat.

In the present specification, the white that the white ink W takes on is not limited to white in the strict meaning that is a surface color of an object which reflects 100 percent all of the wavelengths of visible light and includes what is called white from common sense, such as a so-called "whitish color." For example, (1) a color that is in the color phase range where a mark in Lab system is on a circumference with a radius 20 and inside the circumference on an a*b* plane, and additionally L* is expressed as 70 or greater, in a case where a color is measured using EYE ONE Pro, a spectrophotometer manufactured by X-Rite, Inc, with a setting where color measurement mode: spot color measurement, light source: D50, backing: black, and printable medium: transparent film, (2) a color that is in the color phase range where a mark in Lab system is on a circumference with a radius 20 and inside the circumference on an a*b* plane, and additionally L* is expressed as 70 or greater, in a case where a color is measured using a spectrophotometer CM2022 manufactured by Minolta Co., Ltd, with a setting of color measurement mode D502° viewing field, SCF mode, and white background back, and (3) a color of white that is used as a background of an image as disclosed in JP-A-2004-306591 are defined as white.

According to the embodiments described above, silver particles are caused to be contained in the metallic ink resulting in the metal layer (a glittering base layer) and aluminum pieces are caused to be contained in the glitter ink with the high diffuse reflection rate, formed on the color dot, but the invention is not limited to this configuration. For example, the ink that results in the glittering base layer may contain a metallic pigment resulting from aluminum and the glitter ink formed on the color dot may contain the metallic pigment resulting from silver.

According to the embodiments described above, the printer is numerated as an example, which repeats the operation of discharging the ink while the head is moved by the carriage, and the operation of transporting the printable matter in the transporting direction, but the invention is not limited to this configuration. For example, the printer according to the invention may include a printer that prints a two-dimensional image on the printable medium S by the head discharging the ink toward the printable medium when the printable media S passes below the fixed head that extends over the width length of the printable medium. Furthermore, for example, the printer according to the invention may include a printer that prints the two-dimensional image on the printable medium S positioned in a print region and then transports the printable medium S in the X direction and transports a part of the new printable medium S to the print region by repeating the operation of discharging the ink with respect to the printable medium S transported to the print region while moving the head in the X direction and the operation of moving the head in the Y direction.

What is claimed is:

1. A printing apparatus comprising:

a first nozzle through which to discharge color ink to form a first dot;

a second nozzle through which to discharge at least one of white ink, clear ink, and first glitter ink to form a second dot;

a third nozzle through which to discharge second glitter ink, lower in diffuse reflection rate than the ink discharged from the second nozzle, to form a third dot; and a control unit that controls discharge of the ink through the first nozzle, the second nozzle, and the third nozzle, wherein the control unit performs control in such a manner that an image to be visually recognized from the opposite side of an image formation side via a printable medium is formed by forming a glittering base layer, resulting from the third dot, on a color image and the second dot using the third nozzle, after forming the color image, resulting from the first dot, on the printable medium using the first nozzle, and forming the second dot on the first dot making up the color image using the second nozzle.

2. The printing apparatus according to claim 1, wherein the control unit causes the second dot to be formed in a sub region where the first dot making up the color image is not present, in a region that is on the printable medium and in which the glittering base layer is formed on the printable medium, using the second nozzle.

3. The printing apparatus according to claim 2, wherein the control unit determines a discharge duty when forming the second dot in the sub region where the first dot is not present, as a discharge duty in the range from 5% to 20%.

4. The printing apparatus according to claim 2, wherein the second nozzle is able to form the Second dot with multiple sizes, and wherein the control unit causes the second dot, which has the smallest of the multiple sizes, to be formed in the sub region where the first dot is not present, using the second nozzle.

5. The printing apparatus according to claim 1, wherein the control unit causes the glittering base layer resulting from the first dot and the third dot to be formed using the first nozzle and the third nozzle.

6. The printing apparatus according to claim 1, wherein the first glitter ink is ink that contains aluminum pieces.

7. A printing method of forming an image that is visually recognized from the opposite side of an image formation side via a printable medium, comprising:

forming a color image, resulting from forming a first dot, by discharging color ink onto the printable medium;

forming a second dot by discharging at least one of white ink, clear ink and first glitter ink onto the first dot making up the color image; and forming a glittering base layer, resulting from forming a third dot, by discharging a second glitter ink, lower in low diffuse reflection rate than the ink resulting in the second dot, onto the color image and the second dot.

8. A printed matter that is visually recognized from the opposite side of an image formation side via a printable medium, wherein a color image resulting from a first dot, which is a dot of color ink, is formed on the printable medium, a second dot resulting from discharging at least one of white ink, clear ink, and first glitter ink is formed onto the first dot making up the color image, and a glittering base layer resulting from a third dot, which is a dot of second glitter ink, lower in diffuse reflection rate than the ink resulting in the second dot, is formed on the color image and the second dot.

* * * * *